US012441509B2

(12) United States Patent
Cao

(10) Patent No.: US 12,441,509 B2
(45) Date of Patent: Oct. 14, 2025

(54) STORAGE BASKET WITH HIGH STRENGTH AND BEARING CAPACITY

(71) Applicant: Xin Cao, Huizhou (CN)

(72) Inventor: Guohua Cao, Huizhou (CN)

(73) Assignee: Xin Cao, Huizhou (CN)

( * ) Notice: Subject to any disclaimer, the term of this patent is extended or adjusted under 35 U.S.C. 154(b) by 53 days.

(21) Appl. No.: 18/514,213

(22) Filed: Nov. 20, 2023

(65) Prior Publication Data

US 2025/0145328 A1 May 8, 2025

(30) Foreign Application Priority Data

Nov. 7, 2023 (CN) ..... 202323003060.2

(51) Int. Cl.

| | |
|---|---|
| ***B65D 25/30*** | (2006.01) |
| ***B65D 6/04*** | (2006.01) |
| ***B65D 6/08*** | (2006.01) |
| ***B65D 6/32*** | (2006.01) |
| ***B65D 6/34*** | (2006.01) |

(52) U.S. Cl.

CPC ..... *B65D 7/16* (2013.01); *B65D 7/08* (2013.01); *B65D 7/38* (2013.01); *B65D 7/48* (2013.01); *B65D 25/30* (2013.01)

(58) Field of Classification Search

CPC ..... B65D 7/16; B65D 7/08; B65D 7/28

USPC ..... 220/494

See application file for complete search history.

(56) References Cited

U.S. PATENT DOCUMENTS

| | | | | |
|---|---|---|---|---|
| 8,584,889 | B2 * | 11/2013 | Cheng | A47B 67/04 220/494 |
| 9,586,718 | B2 * | 3/2017 | Tsai | B65D 7/12 |
| 2018/0208354 | A1 * | 7/2018 | Yeh | B65D 7/46 |
| 2022/0063863 | A1 * | 3/2022 | Cortez | B65D 7/16 |

* cited by examiner

*Primary Examiner* — Anthony D Stashick
*Assistant Examiner* — Raven Collins
(74) *Attorney, Agent, or Firm* — Birchwood IP

(57) ABSTRACT

The patent discloses a storage basket with high strength and bearing capacity, including a second metal basket body, wherein two sides of the second metal basket body are fixedly assembled with first metal basket bodies; the first metal basket bodies are assembled and arranged on the two sides of the second metal basket body, so that the first metal basket bodies and the second metal basket body are connected into a whole to form the storage basket; and two side edges, connected to each other, of the first metal basket bodies and the second metal basket body are welded with each other to form a whole or are connected into a whole through Z-shaped connecting components. The storage basket of the patent has high strength and bearing capacity and can assist in finishing more tasks that require load bearing.

16 Claims, 8 Drawing Sheets

STORAGE BASKET WITH HIGH STRENGTH AND BEARING CAPACITY

CROSS-REFERENCE TO RELATED APPLICATIONS

This application claims priority to Chinese Patent Application No. 202323003060.2, filed on Nov. 7, 2023, which is hereby incorporated by reference in its entirety.

TECHNICAL FIELD

This patent relates to the technical field of storage baskets, and in particular, to a storage basket with high strength and bearing capacity.

BACKGROUND

Storage baskets are common daily necessities in daily life. There is a variety of storage baskets with various structures. Objects are placed inside an existing storage basket, and a plurality of storage baskets are hung on a storage rack and are arranged in a stacked manner to fully use a storage space. The storage rack can be provided with rollers for pushing, so as to facilitate free movement. The storage baskets can also be fixedly hung on a wall through hooks.

Generally, to place objects into a storage basket, the objects will be stably placed inside the storage basket; and a bottom of the storage basket will fully bear an overall weight of these objects. The bottom of the existing storage basket is usually manufactured by stamping a mesh plate, basically without any modification or processing, causing poor bearing capacity. Therefore, general storage baskets can only be used to place some light objects in daily life or a small number of folders. Placing heavy objects or thick books into the storage baskets is highly possible to break the bottom mesh plate, causing certain economic loss. However, as the storage baskets are used in every aspect in life, increasingly stringent requirements are put forward to the storage baskets. The storage baskets are required to serve as an assistant in life to help finish more tasks. This requires the storage baskets to have higher strength and higher bearing capacity.

SUMMARY

This patent aims to overcome the drawbacks of low strength and poor bearing capacity in the prior art, and provide a storage basket with high strength and bearing capacity. The storage basket has high strength and bearing capacity and can assist in finishing more tasks that require load bearing.

In order to achieve the above objective, this patent provides a storage basket with high strength and bearing capacity, including a second metal basket body, wherein two sides of the second metal basket body are fixedly assembled with first metal basket bodies; the first metal basket bodies are assembled and arranged on the two sides of the second metal basket body, so that the first metal basket bodies and the second metal basket body are connected into a whole to form the storage basket; and two side edges, connected to each other, of the first metal basket bodies and the second metal basket body are welded with each other to form a whole or are connected into a whole through a Z-shaped connecting component.

Preferably, the second metal basket body includes a second stamped and stretched net, a first metal strip arranged on one side of the second stamped and stretched net, and a second metal strip arranged on the other side of the second stamped and stretched net; the second stamped and stretched net, the first metal strip, and the second metal strip are of integrally stamped and stretched platy net structures; the first metal basket bodies include first stamped and stretched nets, wherein one first stamped and stretched net is spliced onto the first metal strip to form a first spliced part, and the other first stamped and stretched net is spliced onto the second metal strip to form a second spliced part.

Preferably, the first spliced part is welded and fixed to an upper or lower side of the first metal strip by the first stamped and stretched mesh; and the second spliced part is welded and fixed to an upper or lower side of the second metal strip by the first stamped and stretched mesh.

Preferably, the Z-shaped connecting components are Z-shaped interfaces formed by bending end portions of the first metal strip and the second metal strip, and the first stamped and stretched meshes are inserted into the Z-shaped interfaces; and the first stamped and stretched meshes and the second stamped and stretched mesh are connected into a whole by pressing the Z-shaped interfaces.

Preferably, flocking layers are arranged on surfaces of the first metal basket bodies and a surface of the second metal basket body.

Preferably, each of the Z-shaped connecting components is independently bent; one end of each of Z-shaped connecting components is connected to each first metal basket body, and the other end is connected to the second metal basket body; each first metal basket body is inserted into one end of the Z-shaped connecting component, and the second metal basket body is inserted into the other end of the Z-shaped connecting component; and the first metal basket body and the second metal basket body are connected into a whole by pressing the Z-shaped connecting component. The first metal basket bodies and the second metal basket body are either expanded metals or steel meshes.

Preferably, the second metal basket body includes a first bottom surface and first side surfaces arranged on two sides of the first bottom surface; each first metal basket body includes a second side surface and a second bottom surface fixedly connected to the first bottom surface; and at least one integrally stamped inwards or outwards protruding reinforcing rib is arranged on the first bottom surface, the first side surfaces, the second side surfaces, or the second bottom surfaces.

Preferably, the first side surfaces and the first bottom surface are perpendicular to each other or tilt outwards; and the second side surfaces and the second bottom surfaces are perpendicular to each other or tilt outwards. Joint between the first side surfaces and the first bottom surface are arc-shaped or right-angled; and joints between the second side surfaces and the second bottom surfaces are arc-shaped or right-angled.

Preferably, tail ends of the first side surfaces and tail ends of the second side surfaces are sleeved with open edges; the tail ends of the first side surfaces and the tail ends of the second side surfaces are inserted into the open edges; the open edges are V-shaped strip open edges, C-shaped strip open edges, or cambered open edges; or the open edges are sliding rails supporting sliding of the storage basket. Iron wires, iron plates, or wooden bodies can also be arranged at openings to serve as sliding rails or lifting handles.

Preferably, at least one handle configured to push the storage basket to slide is arranged on each of the second side surfaces or the first side surface; and the handle is a groove in various shapes. In order to protect a hand from being cut, a periphery of the handle is further provided with a protective edge. The protective edge wraps around burrs around the handle, which is more beautiful and is not easy to cut a hand.

Compared with the prior art, this patent has the beneficial effects:

This patent includes a second metal basket body; two sides of the second metal basket body are fixedly assembled with first metal basket bodies; the first metal basket bodies are assembled and arranged on the two sides of the second metal basket body, so that the first metal basket bodies and the second metal basket body are connected into a whole to form the storage basket; and two side edges, connected to each other, of the first metal basket bodies and the second metal basket body are welded with each other to form a whole or are connected into a whole through Z-shaped connecting components. Connection achieved through welding or the Z-shaped connecting components can further improve the strength and bearing capacity of the storage basket, so that the storage basket can assist in finishing more tasks that require load bearing.

BRIEF DESCRIPTION OF DRAWINGS

To describe the technical solutions in the embodiments of this patent or in the existing technology more clearly, the following briefly introduces the accompanying drawings for describing the embodiments or the existing technology. Apparently, the accompanying drawings in the following description show some embodiments of this patent, and a person of ordinary skill in the art may still derive other drawings from the accompanying drawings without creative efforts.

In the drawings.

1: first metal basket body; 2: second metal basket body; 21: first bottom surface; 22: first side surface; 3: reinforcing rib; 23: second stamped and stretched mesh; 24: first metal strip; 25: second metal strip; 11: first stamped and stretched mesh; 71: first spliced part; 72: second spliced part; 73: Z-shaped interface; 74: decorative strip; 12: second side surface; 13: second bottom surface; 8: open edge; and 9: handle.

DESCRIPTION OF EMBODIMENTS

The technical solutions in the implementations of this patent are clearly and completely described below with reference to the accompanying drawings in the implementations of this patent. Apparently, the described implementations are some rather than all of the embodiments of this patent. All other implementations obtained by a person of ordinary skill in the art based on the implementations of this patent without making creative efforts shall fall within the protection scope of this patent.

Referring to FIG. 1 to FIG. 8, this patent provides a storage basket with high strength and bearing capacity.

Figure 1:
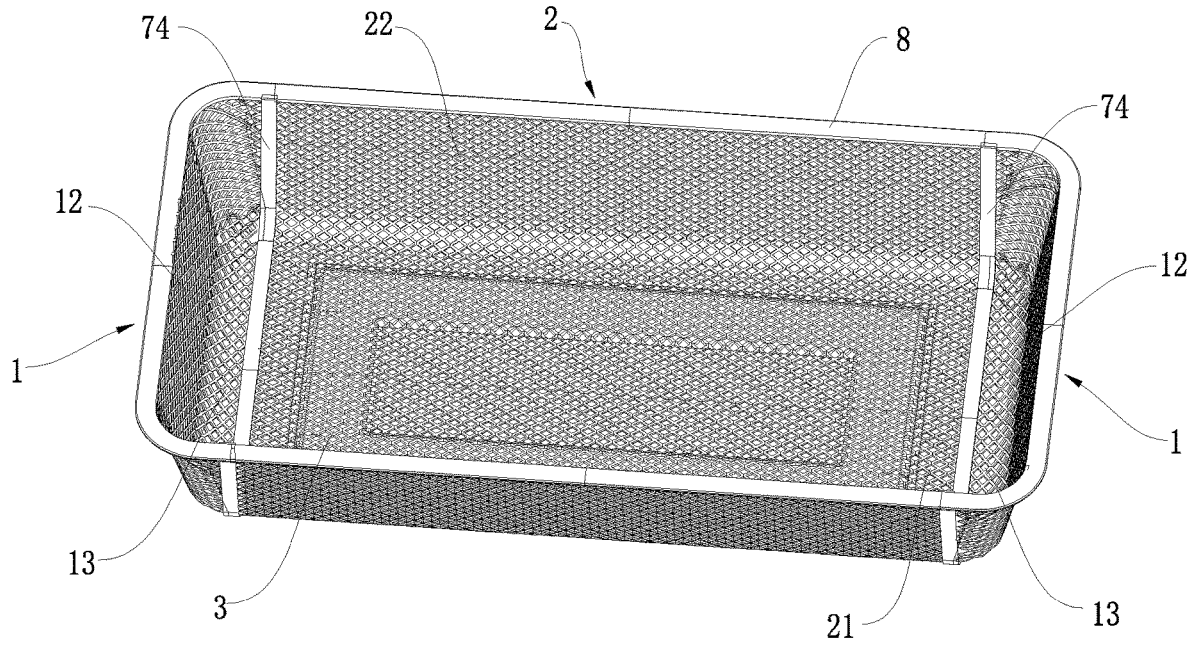
FIG. 1 is a schematic structural diagram of a storage basket according to this patent.

As shown in FIG. 1, an area ratio of a second metal basket body 2 is greater than an area ratio of a first metal basket body 1. The second metal basket body 2 is placed in the middle, and two first metal basket bodies 1 are respectively arranged on two sides of the second metal basket body 2. As shown in FIG. 1, the first metal basket bodies 1 and the second metal basket body 2 are fixedly spliced into a whole to form the storage basket. Further, a splicing manner may be welding or crimping. Joints deform by way of pressing, so that the second metal basket body and the first metal basket bodies are fixedly connected into a whole.

Specifically, if welding is adopted, the first metal basket bodies 1 and the second metal basket body 2 can be welded with each other into a whole.

If Z-shaped connecting components, each of the Z-shaped connecting components is independently bent; one end of each of Z-shaped connecting components is connected to each first metal basket body 1, and the other end is connected to the second metal basket body 2; each first metal basket body 1 is inserted into one end of the Z-shaped connecting component, and the second metal basket body 2 is inserted into the other end of the Z-shaped connecting component; and the first metal basket body 1 and the second metal basket body 2 are connected into a whole by pressing the Z-shaped connecting component. The first metal basket bodies 1 and the second metal basket body 2 are either expanded metals or steel meshes.

Figure 4:
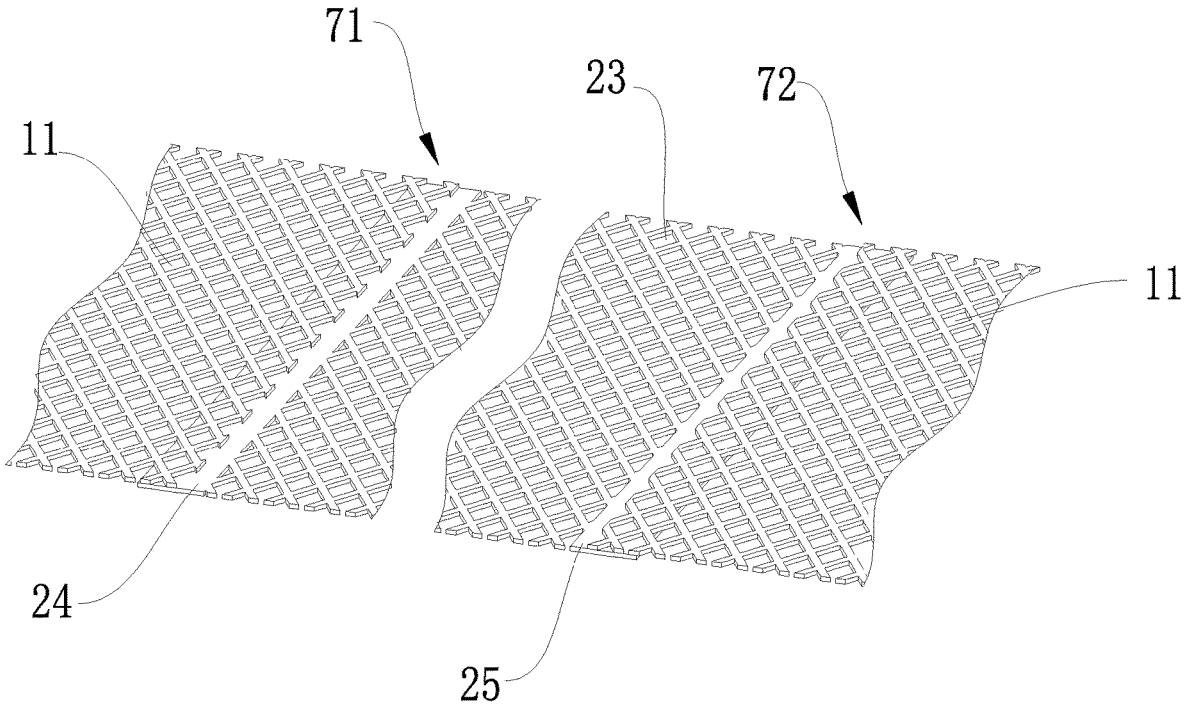
FIG. 4 is a partially schematic diagram of a first spliced part and a second spliced part according to this patent.

As shown in FIG. 4, in an actual production process, the second metal basket body 2 includes a second stamped and stretched mesh 23, a first metal strip 24 arranged on one side of the second stamped and stretched mesh 23, and a second metal strip 25 arranged on the other side of the second stamped and stretched mesh 23. As shown in FIG. 4, the second stamped and stretched mesh 23, the first metal strip 24, and the second metal strip 25 are of integrally stamped and stretched expanded metal structures; the second stamped and stretched mesh 23 is stamped and bent to form a first bottom surface 21, first side surfaces 22, and reinforcing ribs 3; the first metal basket bodies 1 include first stamped and stretched meshes 11; the first stamped and stretched meshes 11 are stamped and bent to form second side surfaces 12 and second bottom surfaces 13; one first stamped and stretched mesh 11 is spliced onto the first metal strip 24 to form a first spliced part 71, and the other first stamped and stretched mesh 11 is spliced onto the second metal strip 25 to form a second spliced part 72. Further, the first metal strip 24 and the second metal strip 25 are respectively connected to the first metal basket bodies 1 on the two sides, so that the first metal basket bodies and the second metal basket body are fixedly connected into a whole to form the storage basket.

Figure 5:
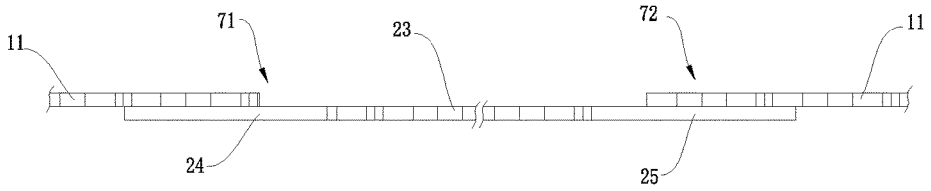
FIG. 5 is a sectional view of a first spliced part and a second spliced part according to this patent.

As shown in FIG. 5, the first spliced part 71 is welded and fixed to an upper or lower side of the first metal strip 24 by the first stamped and stretched mesh 11; and the second spliced part 72 is welded and fixed to an upper or lower side of the second metal strip 25 by the first stamped and stretched mesh 11. Diamond meshes and the metal strips are spliced together by way of welding, so that the first spliced part 71 and the second spliced part 72 are connected more firmly, a hand is not easily cut, and the strength and bearing capacity of the storage basket can also be improved.

Figure 6:
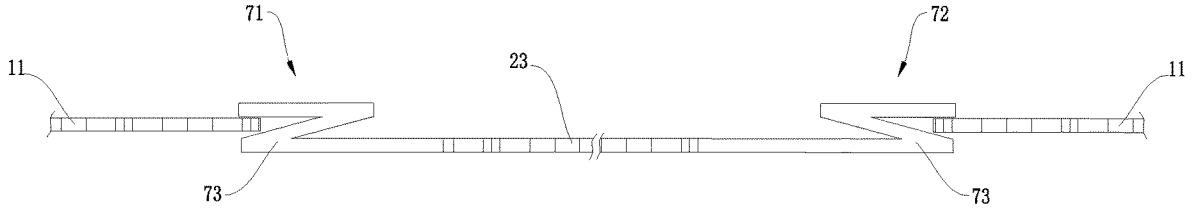
FIG. 6 is a sectional view of a first spliced part and a second spliced part which are provided with Z-shaped interfaces according to this patent.

As shown in FIG. 6, the Z-shaped connecting components are Z-shaped interfaces 73 formed by bending end portions of the first metal strip 24 and the second metal strip 25, and the first stamped and stretched meshes 11 are inserted into the Z-shaped interfaces 73; and the first stamped and stretched meshes 11 and the second stamped and stretched mesh 23 are connected into a whole by pressing the Z-shaped interfaces 73. The Z-shaped interfaces 73 can replace welding, which is conductive to reducing the production cost and facilitates assembling. Meanwhile, the first spliced part 71 and the second spliced part 72 look flatter and more attractive. Of course, this connection manner can also improve the strength and bearing capacity of the storage basket.

Figure 2:
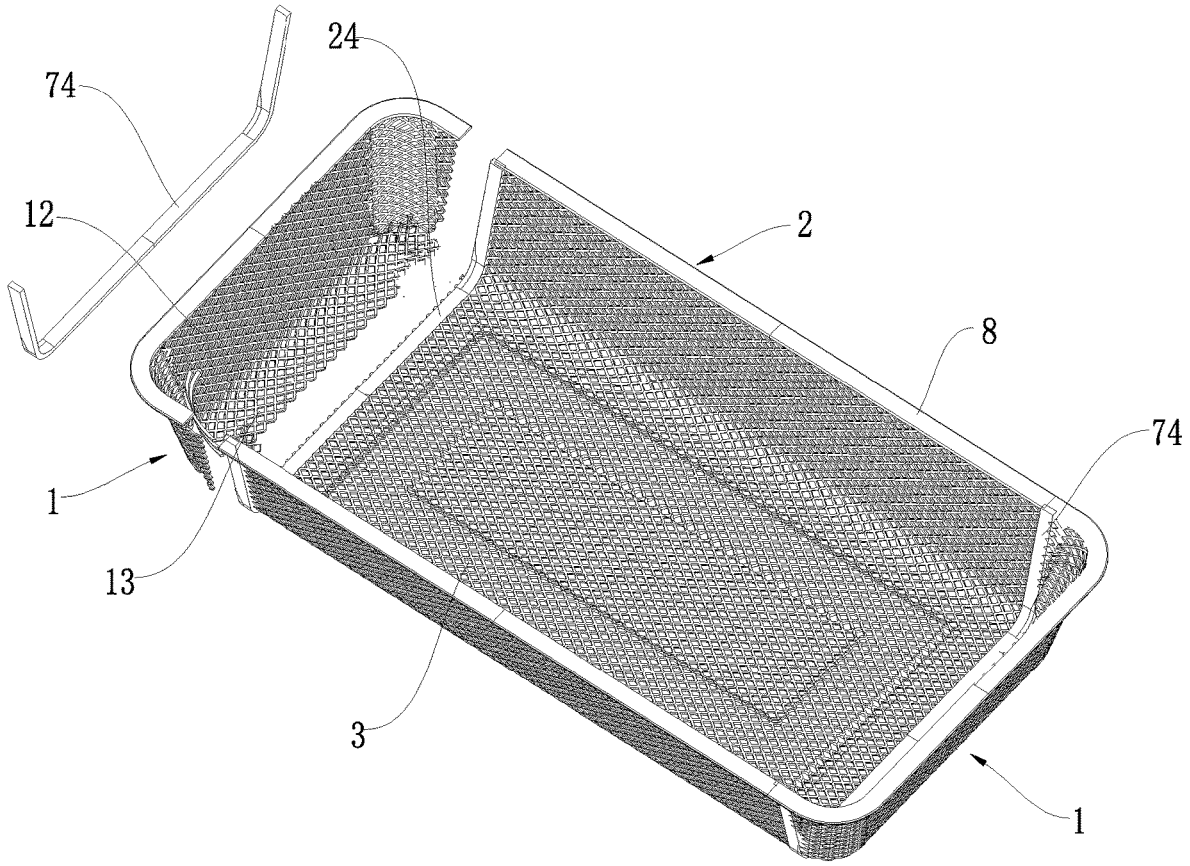
FIG. 2 is a partially exploded diagram of a storage basket according to this patent.

For the purpose of further making this product more beautiful, in this embodiment, as shown in FIG. 2, decorative strips 74 wrap around the first spliced part 71 and the second spliced part 72. The decorative strips 74 achieve a decoration effect and wrap around the first spliced part 71 and the second spliced part 72 to cover internal burrs and machined parts. This can also further improve the strength and bearing capacity of the storage basket. Much further, in other embodiments, the decorative strips 74 can be directly omitted. During machining, the first spliced part 71 and the second spliced part 72 are fully finely ground to remove burrs and machined traces, making the spliced parts smooth and attractive. The decorative strips 74 can be only arranged on one side and can be directly arranged on one side of a machined surface to cover the machined surface and make the machined surface beautiful. The decorative strips 74 can also be symmetrically arranged, namely, the decorative strips 74 are arranged on two sides of the machined surface.

For the purpose of making this product more beautiful and have a soft handfeeling, surfaces of the first metal basket bodies 1 and a surface of the second metal basket body 2 can be flocked. Flocking layers are formed on the surfaces of the first metal basket bodies 1 and the surface of the second metal basket body 2. The stamped and stretched mesh plates after flocking have beautiful appearances and soft handfeelings. Mesh holes of the stamped and stretched mesh plates after flocking will be dense, small, and dustproof, so that this product does not need to be provided with an additional dustproof sleeve. Further details can refer to patent No. CN104858113B: a flocking method for a stamped and stretched mesh plate.

As shown in FIG. 1, the second metal basket body 2 includes a first bottom surface 21 and first side surfaces 22 arranged on two sides of the first bottom surface 21; each first metal basket body 1 includes a second side surface 12 and a second bottom surface 13 fixedly connected to the first bottom surface 21; and at least one integrally stamped inwards or outwards protruding reinforcing rib 3 is arranged on the first bottom surface 21, the first side surfaces 22, the second side surfaces 12, or the second bottom surfaces 13. In this embodiment, the reinforcing rib 3 is square.

The square inwards protruding reinforcing ribs 3 are conductive to improving the strength and bearing capacity of the storage basket. Further, the first bottom surface 21, the first side surfaces 22, the second side surfaces 12, or the second bottom surfaces 13 are stretched and compressed in different extents and distort, which achieves cold hardening, improves the bending resistance, and improves the strength and bearing capacity of the storage basket. Much further, by way of changing cross-sectional structures of the first bottom surface 21, the first side surfaces 22, the second side surfaces 12, or the second bottom surfaces 13, the section modulus in bending is increased, the bending resistance is improved, and the strength and bearing capacity of the storage basket are further improved, so that the storage basket can assist in finishing more tasks that require load bearing.

In this embodiment, for ease of later transportation of the storage basket and mutual stacking of storage baskets, the first side surfaces 22 and the first bottom surface 21 tilt outwards, and the second side surfaces 12 and the second bottom surfaces 13 also tilt outwards. Due to a certain tilting angle, a storage basket above can be put into a storage basket below to achieve mutual stacking and facilitate later transportation.

In other embodiments, the first side surfaces 22 can also be perpendicular to the first bottom surface 21, and the second side surfaces 12 are also perpendicular to the second bottom surfaces 13. Further, for better connection and smooth and fluent transition, joints between the first side surfaces 22 and the first bottom surface 21 are arc-shaped or right-angled; and joints between the second side surfaces 12 and the second bottom surfaces 13 are arc-shaped or right-angled.

In this embodiment, the first side surfaces 22 and the second side surfaces 12 are both formed by stamping a diamond mesh or hexagonal mesh. If they are not treated later, there will be burrs, which can cut fingers and cause a hand to be injured. Therefore, open edges 8 sleeve their tail ends. The open edges 8 are used to surround and block the burrs, and the open edges 8 can also make the tail ends more beautiful. During machining, the tail ends of the first side surfaces 22 and the second side surfaces 12 are inserted into the open edges 8. The open edges 8 are pressed to wrap around the tail ends of the first side surfaces 22 and the second side surfaces 12, are fixedly connected to the tail ends of the first side surfaces 22 and the second side surfaces 12 into a whole, and also improve the strength around the storage basket.

Figure 7:
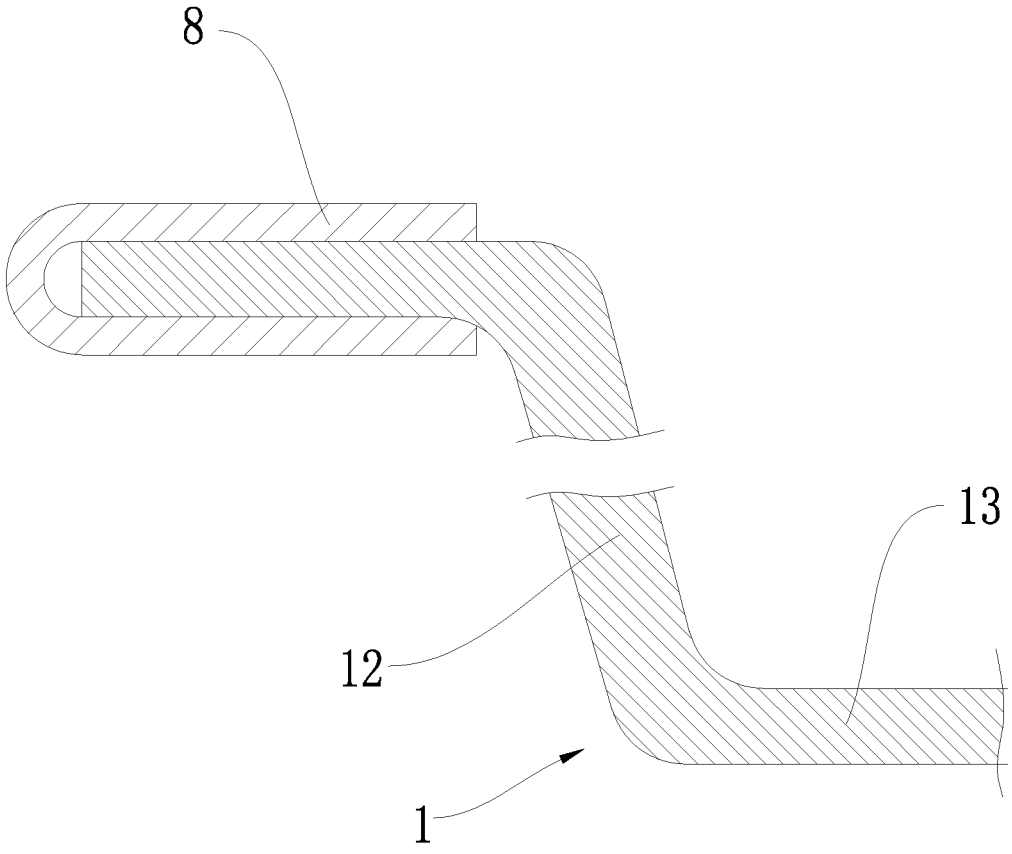
FIG. 7 is a sectional view showing that an open edge is a V-shaped strip open edge according to this patent.
Figure 8:
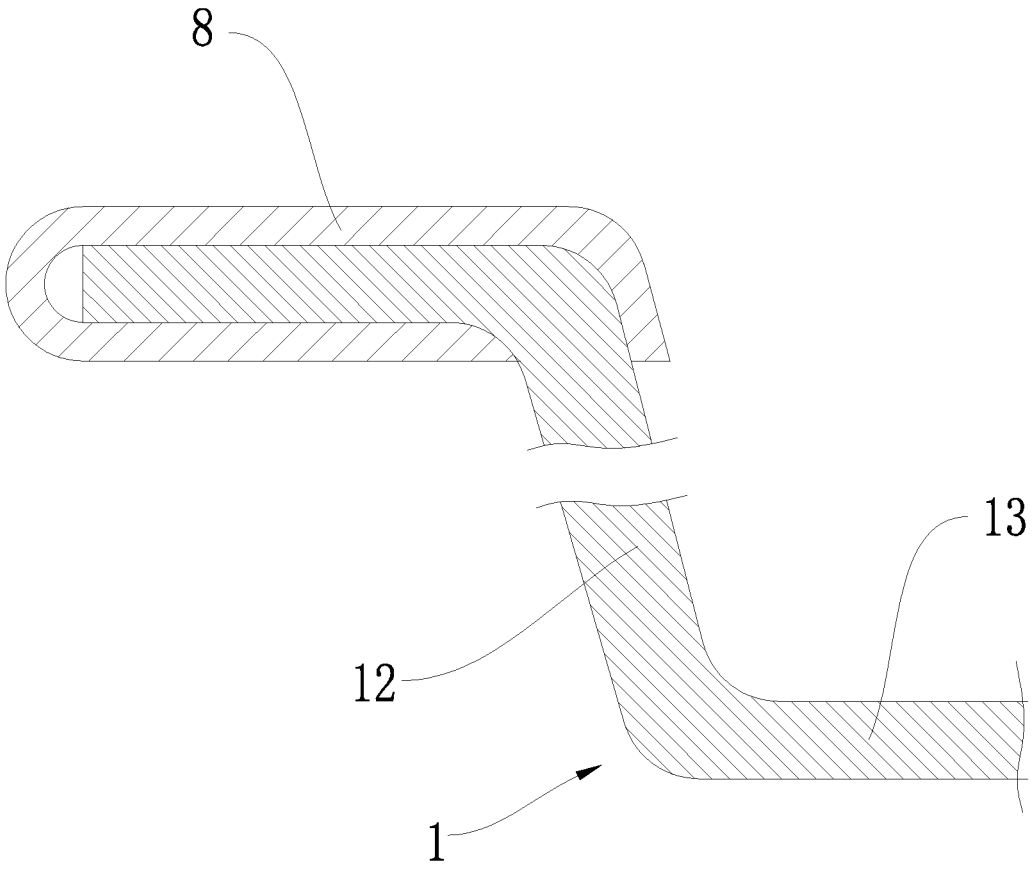
FIG. 8 is a sectional view showing that an open edge is a cambered open edge according to this patent.
Figure 9:
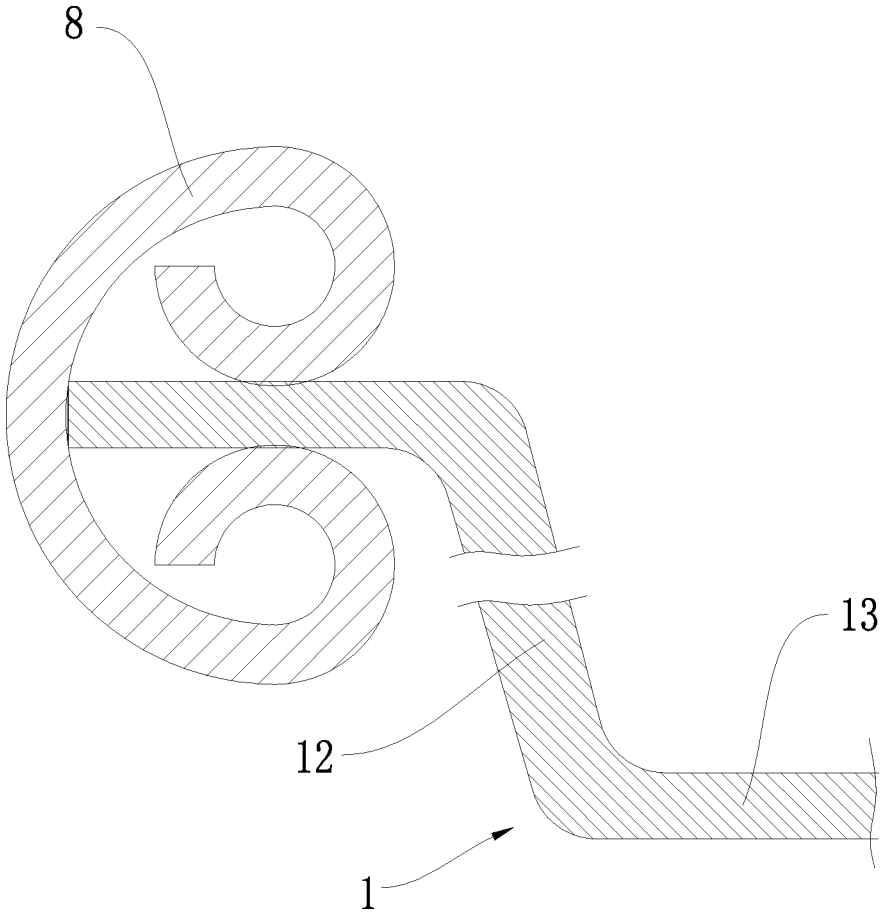
FIG. 9 is a sectional view showing that an open edge is a C-shaped strip open edge according to this patent.

As shown in FIG. 7, the open edges 8 are V-shaped strip open edges, and the V-shaped strip open edges can only protect side edges, so that the protection range is not wide enough. As shown in FIG. 8, cambered open edges can be used to be connected to the diamond meshes of the side surfaces into a whole, making transitions smoother and more beautiful. The cambered open edges can also protect the diamond meshes at corners, thus achieving higher strength. As shown in FIG. 9, the open edges 8 can also be C-shaped strip open edges.

In an actual application process, the storage basket can be placed in a kitchen as a chef's basket, which is configured to store various seasonings and vegetables, can also be used as a vegetable washing basket, and can further be used as a fruit basket to hold fruits.

Much further, as shown in FIG. 7 and FIG. 8, if the storage basket is used as a drawer and stacked on a storage rack, the open edges 8 are sliding rails that support the sliding of the storage basket, making the storage basket easy to push and pull. The surrounding open edges 8 can all be used as the sliding rails. Generally, the open edges 8 in a long-edge direction are used as the sliding rails. Iron wires, iron plates, or wooden bodies can also be arranged at the open edges 8 to serve as sliding rails or lifting handles.

Figure 3:
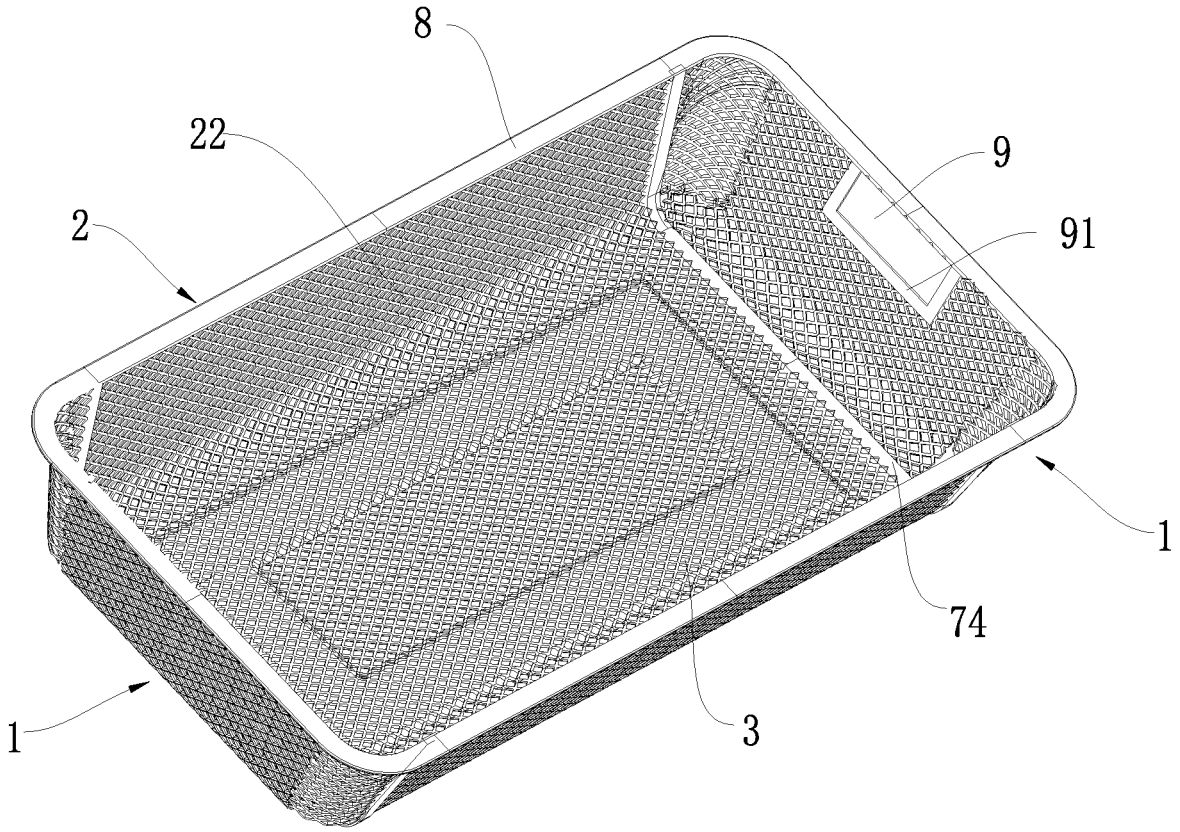
FIG. 3 is a schematic structural diagram of a storage basket provided with a handle and a protective edge according to this patent.

For ease of use of the storage basket as a drawer, as shown in FIG. 3, at least one handle 9 configured to push the storage basket to slide is arranged on each of the second side surfaces 12 or the first side surface 22. During use, a hand is put into the handle 9 to pull out or push in the storage basket. The handle 9 can be a groove in various shapes. The handle can be circular, elliptical, hexagonal, or square. In order to protect the hand from being cut, a periphery of the handle 9 is further provided with a protective edge 91. The protective edge 91 wraps around burrs around the handle 9, which is more beautiful and is not easy to cut a hand.

The above embodiments are preferred implementations of this patent, but the implementations of this patent are not limited by the above embodiments. Any other changes, modifications, substitutions, combinations, or simplifications that are made without deviating from the spirit and principle of this patent shall all be equivalent substitutes and shall all fall within the protection scope of this patent.

What is claimed is:

1. A storage basket with high strength and bearing capacity, comprising a second metal basket body, wherein two sides of the second metal basket body are fixedly assembled with first metal basket bodies; the first metal basket bodies are assembled and arranged on the two sides of the second metal basket body, so that the first metal basket bodies and the second metal basket body are connected into a whole to form the storage basket; and two side edges, connected to each other, of the first metal basket bodies and the second metal basket body are welded with each other to form a whole or are connected into a whole through Z-shaped connecting components;

wherein the second metal basket body comprises a second stamped and stretched mesh, a first metal strip arranged on one side of the second stamped and stretched mesh, and a second metal strip arranged on the other side of the second stamped and stretched mesh; the second stamped and stretched mesh, the first metal strip, and the second metal strip are of integrally stamped and stretched expanded metal structures; the first metal basket bodies comprise first stamped and stretched meshes, wherein one first stamped and stretched mesh is spliced onto the first metal strip to form a first spliced part, and the other first stamped and stretched mesh is spliced onto the second metal strip to form a second spliced part;

wherein the Z-shaped connecting components are Z-shaped interfaces formed by bending end portions of the first metal strip and the second metal strip, and the first stamped and stretched meshes are inserted into the Z-shaped interfaces;

the first stamped and stretched meshes and the second stamped and stretched mesh are connected into a whole by pressing the Z-shaped interfaces.

2. The storage basket with the high strength and bearing capacity according to claim 1, wherein the first spliced part is welded and fixed to an upper or lower side of the first metal strip by the first stamped and stretched mesh; and the second spliced part is welded and fixed to an upper or lower side of the second metal strip by the first stamped and stretched mesh.

3. The storage basket with the high strength and bearing capacity according to claim 1, wherein flocking layers are arranged on surfaces of the first metal basket bodies and a surface of the second metal basket body.

4. The storage basket with the high strength and bearing capacity according to claim 1, wherein each of the Z-shaped connecting components is independently bent; one end of each of Z-shaped connecting components is connected to each first metal basket body, and the other end is connected to the second metal basket body;

each first metal basket body is inserted into one end of the Z-shaped connecting component, and the second metal basket body is inserted into the other end of the Z-shaped connecting component;

the first metal basket body and the second metal basket body are connected into a whole by pressing the Z-shaped connecting component.

5. The storage basket with the high strength and bearing capacity according to claim 4, wherein the first metal basket bodies and the second metal basket body are either expanded metals or steel meshes.

6. The storage basket with the high strength and bearing capacity according to claim 1, wherein the second metal basket body comprises a first bottom surface and first side surfaces arranged on two sides of the first bottom surface;

each first metal basket body comprises a second side surface and a second bottom surface fixedly connected to the first bottom surface; and at least one integrally stamped inwards or outwards protruding reinforcing rib is arranged on the first bottom surface, the first side surfaces, the second side surfaces, or the second bottom surfaces.

7. The storage basket with the high strength and bearing capacity according to claim 6, wherein the first side surfaces and the first bottom surface are perpendicular to each other or tilt outwards; and the second side surfaces and the second bottom surfaces are perpendicular to each other or tilt outwards.

8. The storage basket with the high strength and bearing capacity according to claim 6, wherein joints between the first side surfaces and the first bottom surface are are-shaped or right-angled; and joints between the second side surfaces and the second bottom surfaces are arc-shaped or right-angled.

9. The storage basket with the high strength and bearing capacity according to claim 6, wherein the first side surfaces and the second side surfaces are formed by stamping a diamond mesh or a hexagonal mesh.

10. The storage basket with the high strength and bearing capacity according to claim 9, wherein tail ends of the first side surfaces and tail ends of the second side surfaces are sleeved with open edges.

11. The storage basket with the high strength and bearing capacity according to claim 10, wherein the tail ends of the first side surfaces and the tail ends of the second side surfaces are inserted into the open edges; and the open edges are V-shaped strip open edges, C-shaped strip open edges, or cambered open edges.

12. The storage basket with the high strength and bearing capacity according to claim 11, wherein the open edges are sliding rails supporting sliding of the storage basket.

13. The storage basket with the high strength and bearing capacity according to claim 6, wherein at least one handle configured to push the storage basket to slide is arranged on each of the second side surfaces or the first side surface.

14. The storage basket with the high strength and bearing capacity according to claim 13, wherein the handle is a groove.

15. The storage basket with the high strength and bearing capacity according to claim 14, wherein the groove is circular, elliptical, hexagonal, or square.

16. The storage basket with the high strength and bearing capacity according to claim 13, wherein a periphery of the handle is further provided with a protective edge.

* * * * *